US008087495B2

(12) United States Patent
Szentistvany

(10) Patent No.: US 8,087,495 B2
(45) Date of Patent: Jan. 3, 2012

(54) SAFETY DEVICE FOR STAIRLIFTS

(75) Inventor: Andreas Csaba Szentistvany, Andover (GB)

(73) Assignee: Stannah Stairlifts Limited, Andover (GB)

( * ) Notice: Subject to any disclaimer, the term of this patent is extended or adjusted under 35 U.S.C. 154(b) by 1239 days.

(21) Appl. No.: 10/524,122

(22) PCT Filed: Jul. 16, 2003

(86) PCT No.: PCT/GB03/03062

§ 371 (c)(1),
(2), (4) Date: May 5, 2005

(87) PCT Pub. No.: WO2004/014773

PCT Pub. Date: Feb. 19, 2004

(65) Prior Publication Data

US 2005/0279580 A1 Dec. 22, 2005

(30) Foreign Application Priority Data

Aug. 10, 2002 (GB) ..... 0218652.6

(51) Int. Cl.
*B66B 9/08* (2006.01)
*B66B 1/32* (2006.01)

(52) U.S. Cl. ..... 187/202; 187/201; 187/276; 187/393; 700/304

(58) Field of Classification Search ..... 187/200–202, 187/276, 414; 700/302, 304; *B66B 9/08, B66B 9/06, 1/32, 1/34*
See application file for complete search history.

(56) References Cited

U.S. PATENT DOCUMENTS

| | | | | | |
|---|---|---|---|---|---|
| 4,174,023 | A * | 11/1979 | Dooley | 187/201 |
| 4,904,916 | A * | 2/1990 | Gisske et al. | 318/649 |
| 5,230,405 | A * | 7/1993 | Bartelt | 187/201 |
| 5,720,364 | A * | 2/1998 | Glover | 187/201 |
| 2010/0274409 | A1 * | 10/2010 | Smith et al. | 700/304 |

FOREIGN PATENT DOCUMENTS

| | | | |
|---|---|---|---|
| GB | 2322450 | A | 8/1998 |
| GB | 2339419 | A | 1/2000 |
| GB | 2358389 | A | 7/2001 |
| WO | WO 9929611 | A1 * | 6/1999 |

OTHER PUBLICATIONS

Google Search, Definitions of Brake, Nov. 28, 2007, pp. 1-2 of 3.*

* cited by examiner

*Primary Examiner* — Michael Mansen
*Assistant Examiner* — Stefan Kruer
(74) *Attorney, Agent, or Firm* — Larson & Anderson, LLC

(57) ABSTRACT

The invention describes an over-speed governor (21) for a stairlift (10) which not only triggers upon the carriage (12) exceeding a pre-determined speed, but also triggers in the event the chair (11) departs from the horizontal by more than a predetermined angle. The speed determining function is preferably electronic and the governor operates in both directions without adaptation. Other aspects are described including a trip speed check facility.

12 Claims, 5 Drawing Sheets

FIG. 6
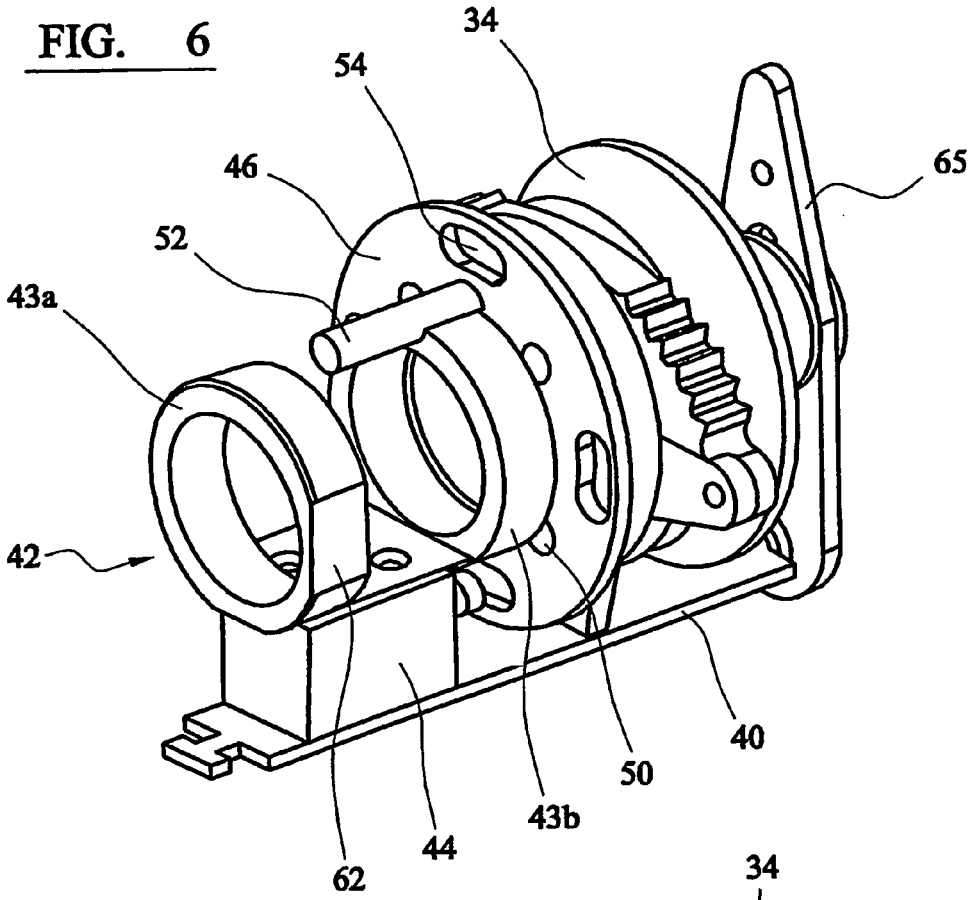
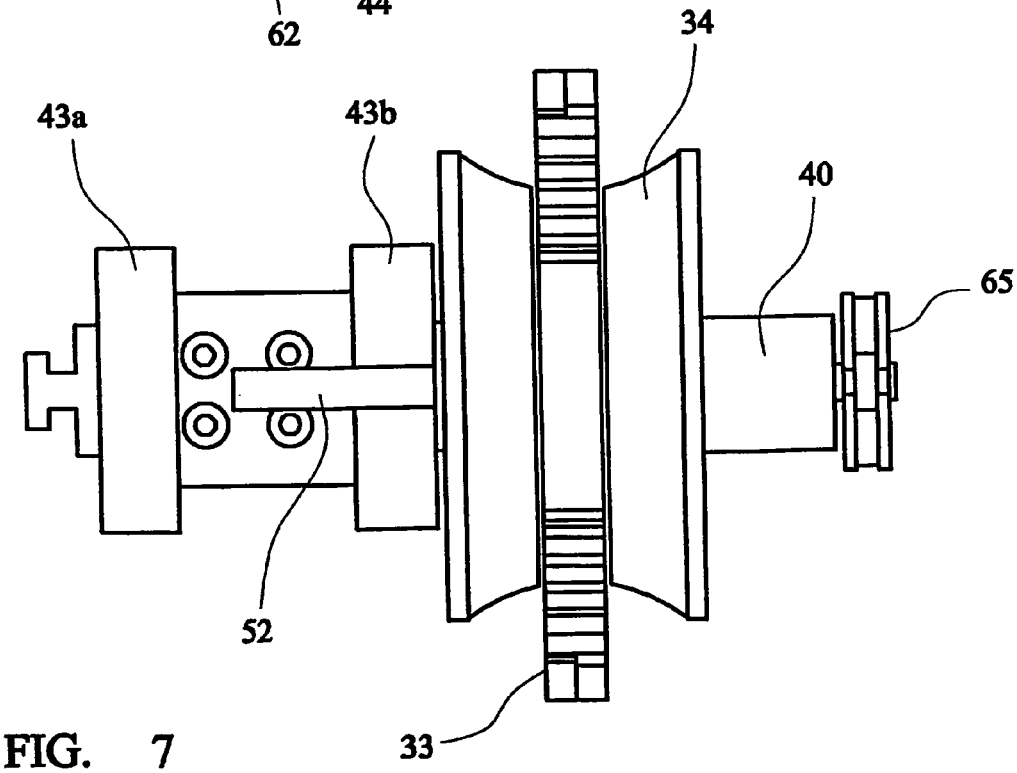
FIG. 7

SAFETY DEVICE FOR STAIRLIFTS

This application is a Section 371 national phase of PCT/GB2003/003062 filed Jul. 16, 2003, and published in English on Feb. 19, 2004 as WO 2004/014773 A1.

FIELD OF THE INVENTION

This invention relates to stairlifts and, in particular, to the control of the movement of a stairlift carriage along a stairlift rail.

BACKGROUND TO THE INVENTION

The movement of a stairlift carriage along a stairlift rail must be carefully controlled. This is particularly so in the case of curved stairlifts. Not only must the speed of the carriage along the rail be controlled within pre-determined limits, but also care must be taken to ensure that, as the stairlift carriage traverses transition bends in the stairlift rail, the chairlift chair does not depart from the horizontal to a noticeable extent.

By regulation, stairlifts must have some form of device which prevents the stairlift carriage going "over-speed". This is typically provided in the form of a mechanical over-speed governor mounted within the carriage which, in the event the stairlift carriage exceeds a pre-determined speed, displaces under centrifugal force, engages the rail, and brakes the carriage from further movement.

Whilst these forms of over-speed governor have been in use for many years, they are not without their problems. Because of manufacturing tolerances, they can be unreliable, and trigger at speeds below the intended trip speed. The consequences can be particularly inconvenient as some installations require a serviceman to be called out in order to release and re-set the over-speed governor.

The problem outlined above is exacerbated by the demand for stairlifts to operate at higher speeds. Since the speed at which the over-speed governor should trip is enshrined in regulation, these higher traveling speeds mean that the normal operating mode is very close to the over-speed governor trip speed. This further increases the likelihood of spurious tripping.

An alternative form of over-speed governor to the centrifugal type, is described in UK Patent Application 2,339,419. The governor described in this patent does not operate under the influence of centrifugal force but, rather, senses the carriage speed electronically. When an over-speed situation is sensed, a solenoid is de-energised. This, in turn, releases a braking member which brings the carriage to a halt.

Whilst the electronic speed sensing feature described in UK Patent Application 2,339,419 addresses the triggering unreliability of conventional governors operating under centrifugal force, the particular form of device described in this patent presents other problems. Firstly, the operation of the device described in UK Patent Application 2,339,419 relies upon the brake release solenoid being kept in a static, energized, configuration at all times. When any mechanical or electromechanical component is kept in a set position for long periods of time, it is susceptible to seizure. This is of particular concern in the case of a component forming part of a safety circuit, such as a stairlift over-speed governor. Further, if an occupier vacates the premises in which the stairlift is fitted, say by going on vacation, then a supply of power must be left on to ensure the over-speed governor does not trigger in the occupier's absence. As a matter of convenience, this is important because, in the event the governor is triggered, and for whatever reason, the governor described in UK Patent Application 2,339,419 will require the attendance of a serviceman to in order to be re-set.

A further concern arising from the use of centrifugal based mechanical over-speed governors is that there is no known, practical, means of testing these devices when in place on an assembled stairlift as, particularly in the case of a rack and pinion drive system, there is no way of creating or simulating an over-speed situation.

As stated above, curved stairlifts require the provision of a levelling function to maintain the chair level, whatever the angle of the rail with respect to the horizontal. Traditionally this function has been provided by various forms of mechanical arrangement, which have been regarded as 'fail-safe'. Now, however, there is an increasing trend amongst stairlift manufacturers to effect levelling using a separate electronically controlled, chair levelling motor.

The advent of electronically controlled chair levelling motors has brought with it, concerns about safety. Rightly or wrongly, there is a concern amongst some in the stairlift industry, that electrical or electronics based systems are, inherently, not as safe as mechanical systems. In the particular case of motorized chair levelling, there is a concern about the possibility of the chair going off-level to a dangerous extent, in the event of main drive failure occurring whilst the carriage is traversing a transition bend in the rail.

Typically the stairlift carriage is slowed when passing over a transition bend. Thus, should a failure occur in the drive system whilst the carriage is traversing a transition bend, it will take a greater length of time for the carriage to build up to a speed sufficient to generate the centrifugal forces necessary to trigger the over-speed governor, than would be the case if the carriage were traversing a straight section of rail.

It will also be appreciated that, when the carriage is traversing a transition bend, the chair levelling motor is in action, under careful electronic control.

The programming of the levelling motor control is established, on the basis of an expected carriage speed, so as to maintain the chair level within carefully defined parameters. Should the carriage drive suddenly fail in this instance, and the carriage speed suddenly increase, it is unlikely that the levelling function could react sufficiently quickly, before the carriage was halted by the over-speed governor, to ensure the chair level remained within acceptable limits. Furthermore, the chair levelling mechanism will have its own 'over-angle' sensor which, when the chair moves off level by more than say 5°, will cause power to the chair levelling motor to be cut. If, at this time, the carriage is still in motion through a transition bend, the chair will be taken beyond this 5° limit.

It is an object of this invention to go at least some way in addressing the requirements and concerns expressed above; or which will at least provide a novel and useful choice.

SUMMARY OF THE INVENTION

Accordingly, in one aspect, the invention provides a stairlift including a stairlift rail; a carriage mounted on said rail for movement there along; a chair pivotally mounted on said carriage; and braking means operable to brake said carriage from further movement on said rail, said stairlift being characterised in that angle determining means are provided to determine out-of-level positions of said chair, said angle determining means being capable of causing actuation of said braking means.

Preferably said braking means includes speed sensing means operable to sense, electronically, the speed of said carriage along said rail.

Preferably said speed sensing means includes a roller in rolling contact with said rail, and means to determine the speed of rotation of said roller.

Preferably said speed sensing means includes at least one magnet which rotates with said roller; and a pick up operable to generate an electromagnetic signal from the passage of said magnet thereby, said pick-up providing a speed output signal representative of the speed of rotation of said roller.

Preferably, in the event of said speed output signal indicating a speed in excess of a pre-determined maximum carriage speed, said braking means triggers a solenoid to engage said braking means with said roller to, thereby, draw a braking member into contact with said rail.

Preferably said braking means is provided, in part, by a microprocessor, said microprocessor being constructed and arranged to receive said speed output signal and, in response to said speed output signal indicating a speed in excess of said pre-determined carriage speed, to generate a command to trigger said solenoid.

Preferably said microprocessor is further constructed and arranged to receive a signal from said angle determining means and, in response to said angle determining means indicating a chair angle in excess of a predetermined angle from the horizontal, to generate a command to trigger said solenoid.

In a second aspect the invention provides control means for a stairlift, said stairlift including:

a stairlift rail having rail sections which, when installed, are arranged at different angles to a horizontal plane;

a carriage mounted on said rail for movement there along;

a chair pivotally mounted on said carriage;

braking means operable to brake said carriage with respect to said rail;

speed sensing means operable to sense the speed of said carriage along said rail; and angle sensing means operable to sense positions of said chair at which the angle thereof with respect to said horizontal plane is at or in excess of a limit;

said control means including a microprocessor operable to receive signals from said speed sensing means and from said angle sensing means, and to generate a command to operate said braking means in response to said speed sensing means sensing a carriage speed in excess of a predetermined maximum, or said angle sensing means sensing a chair angle in excess of a predetermined maximum.

In a third aspect the invention provides a method of controlling a stairlift, said stairlift including:

a stairlift rail having rail sections which, when installed, are arranged at different angles to a horizontal plane;

a carriage mounted on said rail for movement there along;

a chair pivotally mounted on said carriage;

braking means operable to brake said carriage with respect to said rail;

speed sensing means operable to sense the speed of said carriage along said rail; and angle sensing means operable to sense positions of said chair at which the angle thereof with respect to said horizontal plane is at or in excess of a limit;

said method including monitoring the speed of said carriage along said rail and monitoring the angle of said chair with respect to the horizontal and, in the event either said speed or said angle depart from predetermined limits, causing said braking means to be operated.

In a fourth aspect the invention provides a method of testing the operation of an over-speed governor included within a stairlift carriage, said governor acting in combination with electronic speed sensing means and a governor actuation circuit, said method including simulating an electrical signal indicative of carriage speed, applying said signal to said governor actuation circuit and observing a response of said governor.

In a fifth aspect the invention provides a stairlift carriage for movement along a stairlift rail, said carriage including;

a drive motor operable to drive said carriage along said rail;

an over-speed governor operable to brake said carriage with respect to said rail; and limit engagement means operable independently of said over-speed governor and positioned to engage ultimate limit members mounted at each end of said rail, said carriage being characterized in that said over-speed governor and said limit engagement means are constructed and arranged to actuate a common ultimate switch, thereby cutting power to said drive motor.

Preferably said limit engagement means is further constructed and arranged to convey a charging current from said rail to a battery located within said carriage.

In a sixth aspect the invention provides an electronics based over-speed governor for braking a stairlift carriage with respect to a stairlift rail, said governor including:

electronic speed sensing means operable to sense the speed of said carriage along said rail;

a braking member included within said carriage and displaceable into contact with said rail; and a solenoid actuated in response to an over-speed state being sensed by said speed sensing means to cause displacement of said braking member, said governor being characterized in that, when said carriage is stationary, said solenoid may be energised and de-energised without causing displacement of said braking member.

In a seventh aspect the invention provides a stairlift carriage including the over-speed governor as set forth above, wherein said solenoid is energised and de-energised each time power is respectively supplied to or removed from, said carriage.

Many variations in the way the present invention can be performed win present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future. The scope of the invention should be limited by the appended claims alone.

BRIEF DESCRIPTION OF THE DRAWINGS

The various aspects of the invention will now be described with reference to Accompanying drawings in which:

FIG. 6: shows an isometric view of the over-speed governor assembly separated from the remainder of the stairlift carriage assembly;

FIG. 7: shows a plan view of the assembly shown in FIG. 6; and

DESCRIPTION OF WORKING EMBODIMENT

Figure 1:
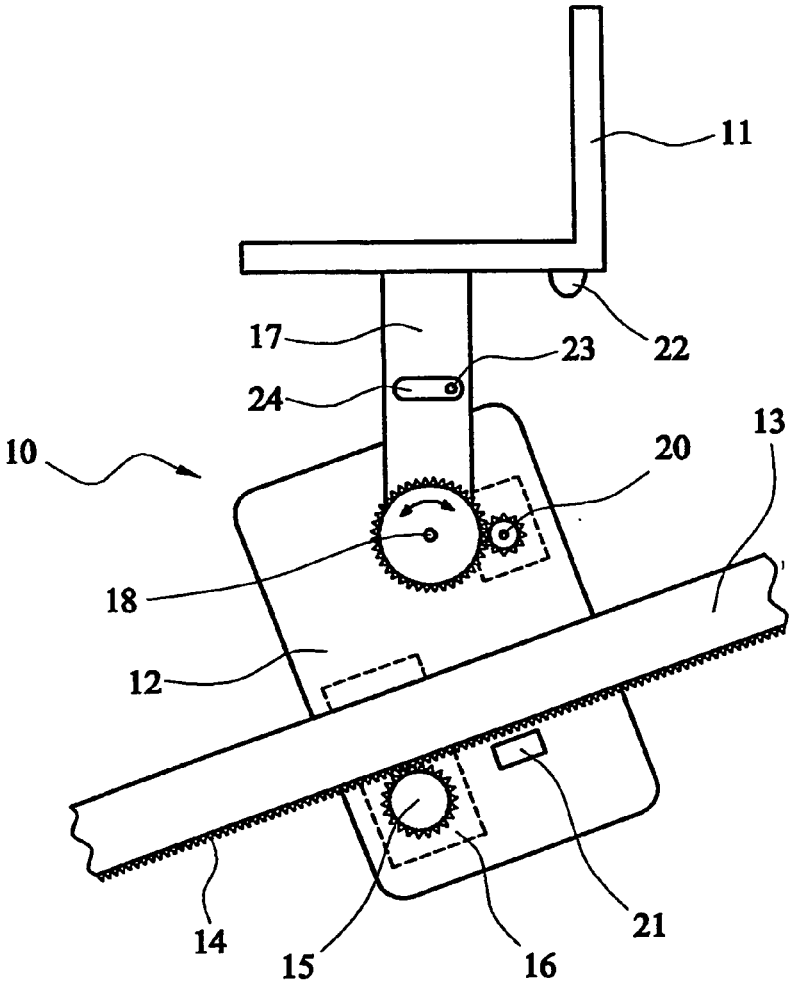
FIG. 1: shows a schematic view of a stairlift assembly incorporating the various aspects of the invention.

Referring firstly to FIG. 1, the present invention provides an over-speed governor for a stairlift assembly 10. In the particular form shown, the stairlift assembly 10 includes a chair 11 mounted on carriage 12. In the conventional manner, the carriage 12 is supported on a number of rollers (not shown) for movement along a stairlift rail 13.

The carriage 12 is displaced along the rail 13 by suitable drive means. In the form shown, the drive means comprises a rack 14 mounted on the rail, the rack being engaged by a drive pinion 15 mounted on the output of carriage drive motor and gearbox 16, mounted in the carriage.

Although not shown in the drawings the rail 13, in this context, includes a number of sections which are arranged at differing angles to a horizontal plane. For this reason the angle of the chair 11 must be capable of adjustment to ensure that, whatever the angle of the rail section with respect to the horizontal, the seat surface of the chair 11 can always be maintained horizontal. To this end, chair 11 is supported on an interface 17, which interface is pivotally mounted at 18 on the carriage 12. In the form shown, level adjustment of the chair is effected substantially as described in our European Patent 0 738 232. Thus, a chair leveling motor 20 is provided which, under electronic control, can pivot the interface 17 with respect to the carriage 12 as the stairlift moves over transition bends in the rail 13.

It will be appreciated, however, that the precise method upon which chair levelling is effected does not form part of the present invention, although the invention is particularly suited to electronic based stairlift levelling systems.

As stated in the preamble above, stairlifts are required, by regulation, to have some form of braking means or over-speed governor to brake the carriage to a halt on the rail in the event of a failure which causes the carriage speed to exceed a predetermined maximum limit. This over-speed governor is indicated by reference numeral 21 in FIG. 1.

Additionally, and particularly in the case of stairlift installations having a separate chair levelling motor 20, means must be provided to ensure the chair 11 does not go off-level by more than a small margin, say 5°. To this end, angle determining means such as, for example, angle sensor 22 is provided on the underside of chair 11. The sensor 22 generates electronic output signals proportional to the tilt angle to either side of a vertical axis, and thus the outputs can be processed and used as triggers to cut power to the drive systems of the installation 10 when the chair angle limits are reached. As described in our European Patent 0 738 232, when the angular limit of the chair 11 is reached, a mechanical interlock such as pin 23 acting in slot 24 may also be triggered to prevent the chair 11 going further off-level.

It cannot, of course, be predicted when drive system failure may occur which, in turn, leads to operation of the over-speed governor 21. There is a particular concern that the consequences could be more serious in the event failure occurred whilst the carriage 12 was negotiating a transition bend in the rail. It will be appreciated, by those skilled in the art, that transition bends are those types of bends which link adjacent sections of rail arranged at different angles to the horizontal.

It is common to slow the stairlift carriage as it negotiates bends in the rail. This is particularly so in those installations employing a separate, electronically controlled chair levelling motor 20. In such cases, the motion of motor 20 must be related, with precision, to the speed of carriage 12, to not only ensure that the chair remains within narrow limits around the horizontal at all times, but also to ensure that the rate of carriage speed and/or chair levelling does not cause alarm to the stairlift user.

Bearing in mind that the carriage is moving slower when negotiating a transition bend, it will therefore physically move further (compared with the case where the carriage is moving along a straight section of rail) before the speed becomes sufficient to generate the centrifugal forces necessary to trip the over-speed governor. Further, it is whilst the carriage 12 is negotiating transition bends, that the chair levelling motor 20 is in operation. If there were to be a sudden increase in carriage speed due to drive failure, the control system operating motor 20 simply could not react fast enough to prevent chair 11 going off-level by more than 5°, and possibly not rapidly enough to avoid a user being ejected from the chair. The problem is exacerbated by the fact that the safety systems built into the chair levelling system will, by then, have locked the chair to the carriage as the chair has gone off level by more than 5°.

Thus, in one aspect, the present invention envisages operation of the over-speed governor not just in response to the speed of carriage 12, but also in response to over limit positions of the chair 11.

Figure 2:
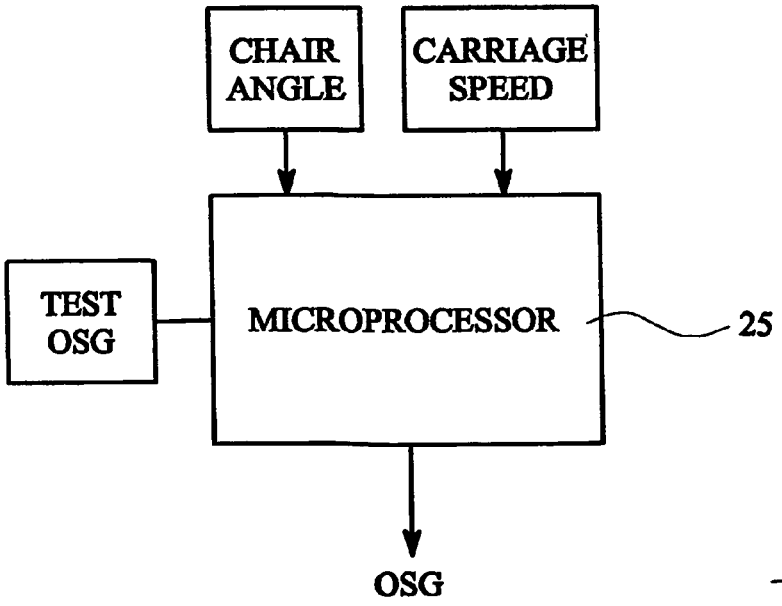
FIG. 2: shows a schematic logic diagram applicable to a control system in a stairlift according to the invention.

Referring to FIG. 2, signals which represent both chair level (determined from the level sensors 22) and a signal representing carriage speed 12 (which may be determined in the manner described in greater detail below) are directed to a form of electronic intelligence, such as a microprocessor 25. The signals from the two inputs are processed within the microprocessor 25 and, in the event of pre-defined limits being sensed in either of the inputs, a signal is directed to trigger the over-speed governor 21 and thereby lock the carriage 12 to the rail 13.

Figure 3:
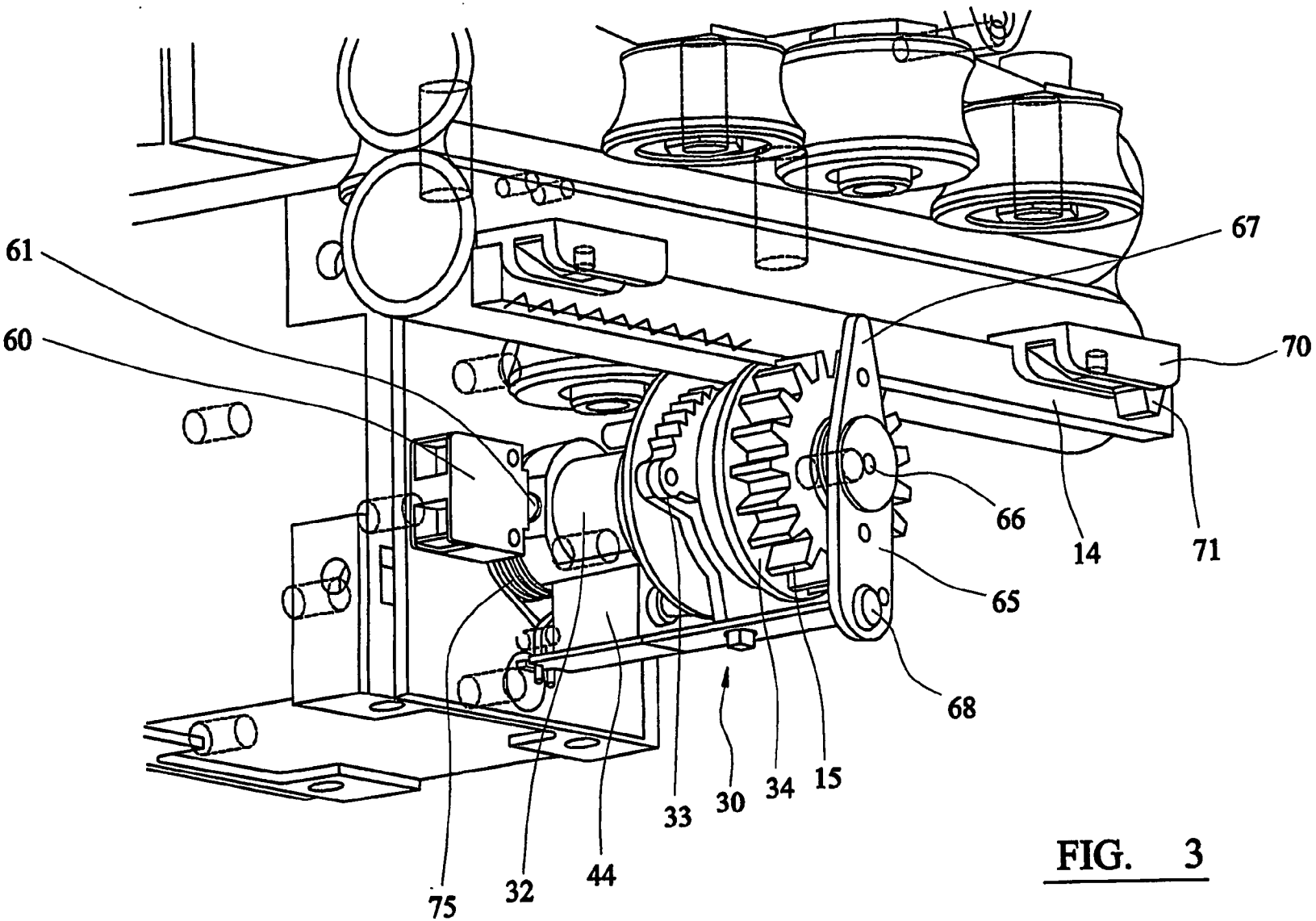
FIG. 3: shows an underside isometric view of an over-speed governor forming part of a stairlift assembly according to the invention.
Figure 4:
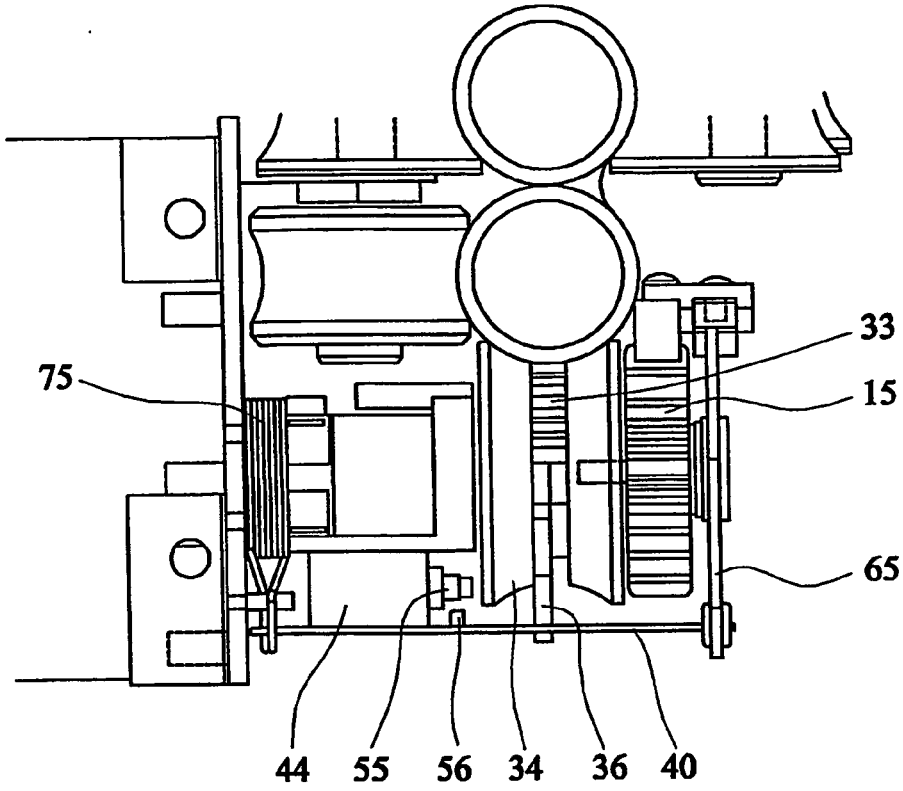
FIG. 4: shows an end elevational view of the assembly shown in FIG. 3.
Figure 5:
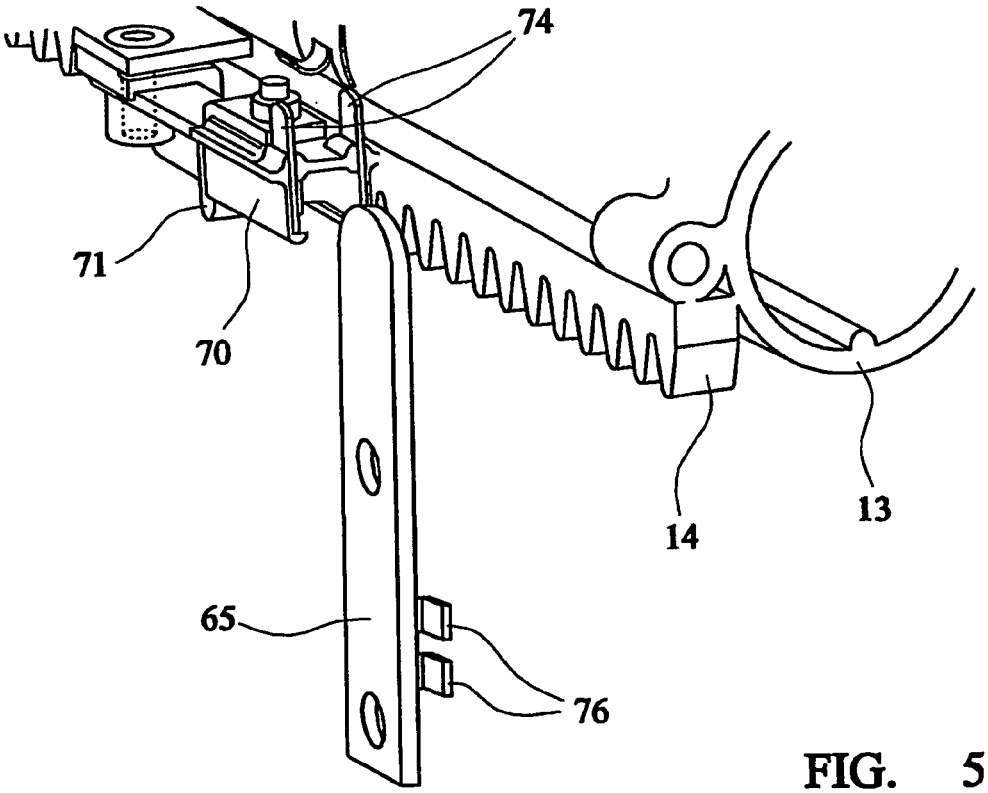
FIG. 5: shows an isometric view, in a larger scale, of a charging arrangement enabled by the invention.

Turning now to FIGS. 3 to 5, an over-speed governor assembly 30 is provided, mounted on the carriage 12, but able to engage the rail 13 to brake the carriage 12 against further movement on the rail. As can be seen, the over-speed governor 30 is mounted, concentrically with the drive pinion 15, about the main drive shaft 32 of the stairlift. However, as will be described in greater detail below, the over-speed governor is incorporated in an assembly which allows the drive shaft 32 and drive pinion 15 to rotate freely with respect to the over-speed governor.

In the form shown, the over-speed governor includes a cam member 33 which is mounted about the centre of bottom roller 34 in such a manner that bottom roller 34 may rotate freely with respect to the cam 33. As can be seen, the cam 33 includes teeth 33*a* on the upper surfaces thereof which, when the over-speed governor is triggered, engage the surface of rail 13. The arrangement is such that the cam 33 is equally effective no matter in which direction the carriage 12 is traveling.

Figure 8:
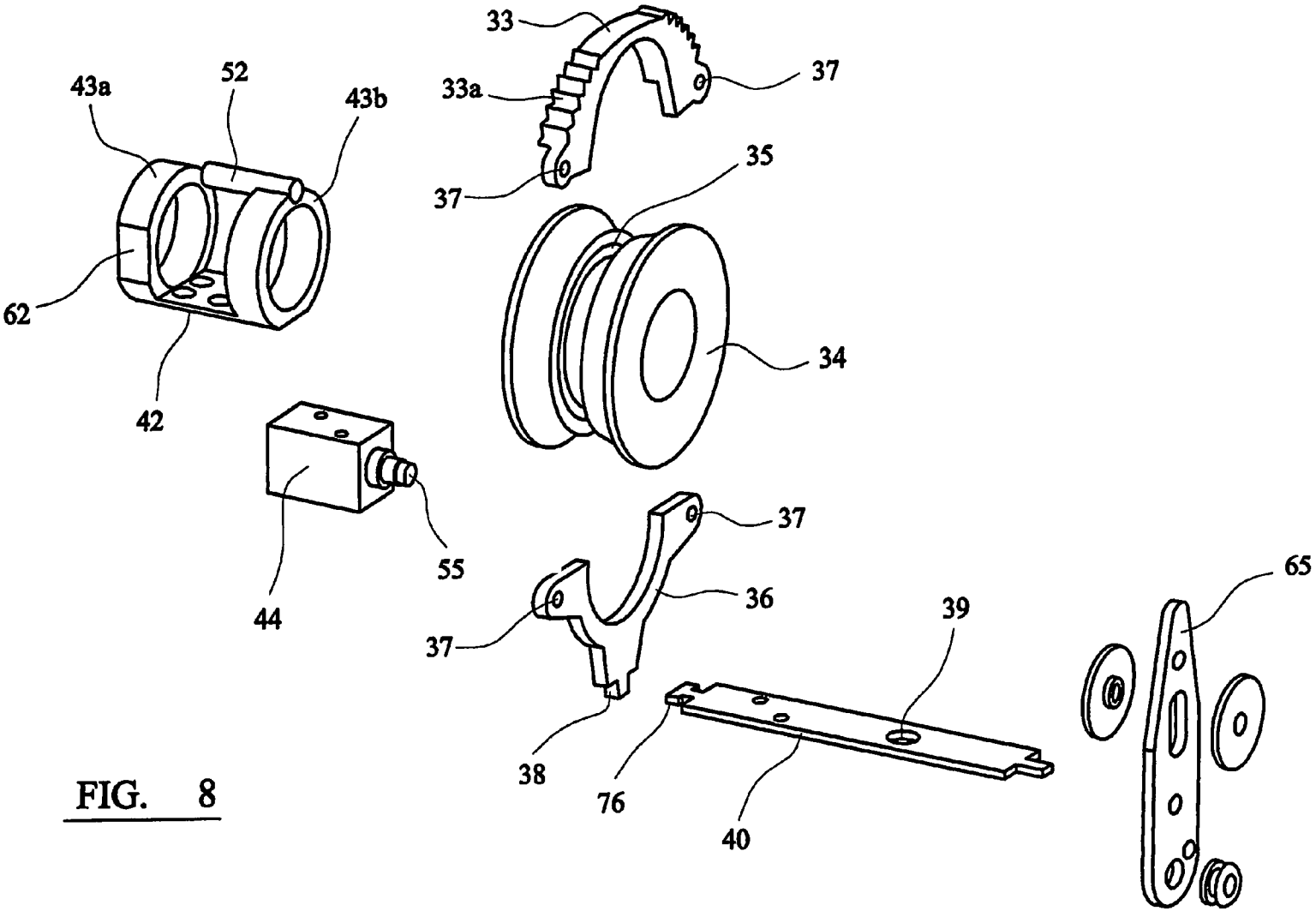
FIG. 8: shows an exploded view of the components forming the assembly shown in FIG. 6.

Referring now to FIG. 8, it can be seen that the cam member 33 is retained in central groove 35 extending about the bottom roller 34, by means of a yoke 36, the cam 33 and yoke 36 being fixed together by bolts or the like (not shown) passed through fixing apertures 37. At its lower end, the yoke 36 is provided with an extending tab 38 which engages in aperture 39 in switch actuation plate 40.

Referring to FIGS. 6 and 7, the over-speed governor assembly 30 further includes a cradle 42 having spaced aligned rings 43*a* and 43*b* which are sized to provide a sliding fit over drive shaft 32 and, in combination with bottom roller 34, support the assembly 30 on the drive shaft 32. Fixed to the underside of the cradle 42 is a solenoid 44. The switch actuation plate 40 is, in turn, fixed to the underside of the solenoid 44.

It will thus be appreciated that the entire over-speed governor assembly can swivel, at least to some extent, about the drive shaft 32.

As can also be seen from FIGS. 6 and 7, the rear surface 46 of bottom roller 34 has mounted therein, a series of permanent magnets 50. Mounted on cradle ring 43*b*, adjacent the bottom roller 34, is a magnetically responsive proximity sensor 52. This proximity sensor 52 is positioned on the same arc as is created when the permanent magnets 50 rotate with the bottom roller 34. Thus, as is well known, when each magnet 50 passes proximity sensor 52, a pulse is created, the time lapse between successive pulses giving a direct indication of the speed of rotation of the bottom roller 34.

The output signal from proximity sensor is advantageously processed and monitored by microprocessor 25.

Also included in the rear surface 46 of roller 34 are a number of lock slots 54. These slots 54 are positioned at such a radius from the centre of rotation of the roller 34 that they may, in use, receive the pin 55 of solenoid 44. Thus, when solenoid 44 is de-activated, pin 55 extends under the influence of a spring (not shown) included within solenoid 44, and engages in one of the slots 54. Should the roller 34 be rotating when the pin 55 extends, the entire assembly 30 will be rotated about drive shaft 32 thus bringing cam surfaces 33*a* into engagement with the outer surface of rail 13.

A further sensor 56, which may be an optical electrical sensor of some suitable form, is preferably provided to sense if the solenoid pin is in its extended or retracted position, and to provide the appropriate status information to the microprocessor 25.

Also illustrated in FIGS. 3 to 5 is an ultimate switch 60. This switch is called an ultimate switch because it acts as a breaker in the ultimate safety circuit of the stairlift installation.

As can be seen, the ultimate switch 60 is positioned on the carriage chassis such that its actuating pin 61 normally engages a flat surface part 62 formed on ring 43*a* of the cradle 42. Thus, as the cradle 42 is rotated in either a clockwise or anti-clockwise direction about drive shaft 32, such as will happen when solenoid pin 55 locks into one of locking slots 54, the switch 60 will be actuated causing the power to be cut-off to the drive motor 16 and seat leveling motor 20.

In a further aspect, the invention combines features of the limit switches with the over-speed governor assembly. To this end, pivotally mounted at 66 on the outer end of drive shaft 32, is a trigger plate 65. The trigger plate 65 is tapered at its upper end 67 and is engaged at its lower end 68 with the switch actuation plate 40. The upper end 67 of the trigger plate is configured and positioned so as to engage charging/stop ramps 70 provided at each end of the stairlift rail 13. Each of the stop ramps 70 includes an ultimate limit 71 which, in the event of failure of the normal stopping facilities provided at each end of the rail, ensures the ultimate switch is triggered to bring the carriage to a halt. To this end, should the need arise, ultimate limit 71 engages end 67 of the trigger plate causing trigger plate to rotate about pivot 66. This, in turn, causes the switch actuation plate 40 to be displaced, so rotating the cradle 42 about drive shaft 32. When this occurs, the flat 62 on cradle 42 is moved out of its 'neutral' state so tripping switch 60 and causing power to be cut to the stairlift drive motor.

Referring now to FIG. 5, a slightly different form of trigger plate and charging ramp assembly is shown. In this case, the trigger plate also serves as a conductor to link one or more batteries (not shown) provided internally of the carriage, to the charging ramps 70. In this way, when the plate 65 is engaged with a ramp 70, the batteries which provide power for the stairlift installation, can be charged.

In the form shown, one side of the ramp 70 is the neutral, while the other side constitutes the power, the two sides being independently charged through projecting terminals 74. The trigger plate 65 is defined by, or incorporates, a double-sided printed circuit board (pcb) having contacts to engage the opposed terminals within the ramp 70. The plate 65 is, in turn, provided with output terminals 76 which are wired to the batteries.

Finally, it will be noted from FIGS. 3 and 4 that a torsion spring 75 is mounted about drive shaft 32 between the over-speed governor assembly and the chassis of the carriage. This coil spring is engaged with inner end 76 of the switch actuation plate and serves to maintain the over-speed governor assembly 30, and the trigger plate 65, in a central position during normal operation.

In another aspect, the invention further provides a method of testing the function of the over-speed governor, something which is, for all practical purposes, impossible in existing mechanical based arrangements.

Given that proximity sensor 52 provides an output which is indicative of carriage speed, this output can be simulated in a stand alone testing device—particularly an output reflecting the speed at which the governor should be triggered. This test output is then applied to microprocessor 25 in a 'test mode' and the operation of the solenoid 44 observed.

The operation of the apparatus above described is as follows: In the normal operating condition, the over-speed governor assembly 30 and trigger plate 65 are in the normal central position as illustrated in FIG. 3. Should over-speed of the carriage be detected by analysis of the pulses derived from interaction of magnets 50 and proximity sensor 52, a signal will be sent to solenoid 44, de-activating the solenoid and thereby releasing pin 55 to engage in one of the locking slots 54. The rotating roller thus draws the cam surfaces 33*a* of the cam plate 33 into engagement with the surface of rail 13, which brakes the carriage 12 to a halt. At the same time, the rotation of the assembly 30, including of the cradle 42, causes the isolation switch 60 to be triggered cutting off power to the stairlift motor.

Simultaneously with the speed of bottom roller 32 being monitored by interaction of magnets 50 and proximity sensor 52, the angle of the chair is also being monitored by microprocessor 25 receiving input from the level sensors 22. Should the sensors 22 determine an "over-angle" state, then once again the microprocessor 25 sends a signal to solenoid 44 releasing actuating pin and thus activating the over-speed governor and isolation switch 60.

Independently of the over-speed function or the chair angle monitoring function, isolation switch 60 can also be activated at each end of the stairlift's travel by engagement of trigger plate 65 with the end stops 70.

It will thus be appreciated that the present invention, at least in the case of the working embodiment described herein, provides for level control to be maintained in the event of drive failure on transition and helical bends, but also combines elements of the over-speed function and ultimate limit switch function to provide an efficient and compact arrangement.

The invention claimed is:

1. A stairlift comprising a stairlift rail; a carriage mounted on said rail for movement there along; a chair mounted on said carriage; over-speed braking means operable to brake said carriage from further movement on said rail when the speed of said carriage on said rail exceeds a pre-deteimined maximum speed, and angle determining means for determining out-of-level positions of said chair, said angle determining means being capable of causing actuation of said over-speed braking means.

2. A stairlift as claimed in claim 1 wherein said over-speed braking means comprises speed sensing means operable to sense, electronically, the speed of said carriage along said rail.

3. A stairlift as claimed in claim 2 wherein said speed sensing means comprises a roller in rolling contact with said rail; and means to determine the speed of rotation of said roller.

4. A stairlift as claimed in claim 3 wherein said speed sensing means comprises at least one magnet which rotates with said roller; and a pick up operable to generate an electromagnetic signal from the passage of said magnet thereby, said pick-up providing a speed output signal representative of the speed of rotation of said roller.

5. A stairlift as claimed in claim 4 wherein, in the event of said speed output signal indicating a speed in excess of the pre-determined maximum carriage speed, said over-speed braking means triggers a solenoid to engage said over-speed braking means with said roller and, thereby, cause a braking member to engage with said rail.

6. A stairlift as claimed in claim 5, wherein said solenoid is energised and de-energised each time power is respectively supplied to or removed from, said carriage.

7. A stairlift as claimed in claim 1 wherein said over-speed braking means is provided, in part, by a microprocessor, said microprocessor being programmed to receive a speed output signal and, in response to said speed output signal indicating a speed in excess of said pre-determined carriage speed, to generate a command to trigger a solenoid to engage said over-speed braking means.

8. A stairlift as claimed in claim 7 wherein said microprocessor is further programmed to receive a signal from said angle determining means and, in response to said angle determining means indicating a chair angle in excess of a predetermined angle from the horizontal, to generate a command to trigger said solenoid.

9. Control means for a stairlift, said stairlift comprising: a stairlift rail having rail sections which, when installed, are arranged at different angles to a horizontal plane; a carriage mounted on said rail for movement there along; a chair pivotally mounted on said carriage; braking means operable to brake said carriage with respect to said rail; speed sensing means operable to sense the speed of said carriage along said rail; and angle sensing means operable to sense positions of said chair at which the angle thereof with respect to said horizontal plane is at or in excess of a limit; said control means including a microprocessor operable to receive signals from said speed sensing means and from said angle sensing means, and to generate a command to operate said braking means in response to said speed sensing means sensing a carriage speed in excess of a predetermined maximum, or said angle sensing means sensing a chair angle in excess of a predetermined maximum.

10. A method of controlling a stairlift, said stairlift comprising: a stairlift rail having rail sections which, when installed, are arranged at different angles to a horizontal plane; a carriage mounted on said rail for movement there along; a chair mounted on said carriage; braking means operable to brake said carriage with respect to said rail; speed sensing means operable to sense the speed of said carriage along said rail; and angle sensing means operable to sense positions of said chair at which the angle thereof with respect to said horizontal plane is at or in excess of a limit; said method comprising the steps of monitoring the speed of said carriage along said rail and monitoring the angle of said chair with respect to the horizontal and, in the event either said speed or said angle depart from predetermined limits, causing said braking means to be operated.

11. An electronics based over-speed governor for braking a stairlift carriage with respect to a stairlift rail, said governor comprising: electronic speed sensing means operable to sense the speed of said carriage along said rail; a braking member included within said carriage and displaceable into contact with said rail; and a solenoid actuated in response to an over-speed state being sensed by said speed sensing means to cause displacement of said braking member, wherein, when said carriage is stationary, said solenoid may be energised and de-energised without causing displacement of said braking member.

12. A stairlift carriage comprising the over-speed governor as claimed in claim 11, wherein said solenoid is energised and de-energised each time power is respectively supplied to or removed from, said carriage.

* * * * *